United States Patent [19]

Ergezinger

[11] Patent Number: 4,731,099

[45] Date of Patent: Mar. 15, 1988

[54] PROCESS FOR TREATING AQUEOUS CONDENSATE

[75] Inventor: Jakob Ergezinger, Bad Vilbel, Fed. Rep. of Germany

[73] Assignee: Metallgesellschaft Aktiengesellschaft, Frankfurt am Main, Fed. Rep. of Germany

[21] Appl. No.: 925,881

[22] Filed: Oct. 31, 1986

[30] Foreign Application Priority Data

Nov. 1, 1985 [EP] European Pat. Off. ..... 85201775

[51] Int. Cl.[4] ..... C10J 3/16; C10J 3/08; C10J 3/14

[52] U.S. Cl. ..... 48/197 R; 48/202; 48/206

[58] Field of Search ..... 48/197 R, 202, 206, 48/210

[56] References Cited

U.S. PATENT DOCUMENTS

| | | | |
|---|---|---|---|
| 3,870,480 | 3/1975 | Moss | 48/200 |
| 3,971,639 | 7/1976 | Matthews | 48/202 |
| 4,065,273 | 12/1977 | Rudolph | 48/206 |
| 4,175,929 | 11/1979 | Frumerman et al. | 48/202 |
| 4,211,540 | 7/1980 | Netzer | 48/202 |
| 4,426,810 | 1/1984 | Rudolph et al. | 48/206 |
| 4,444,568 | 4/1984 | Beisswenger et al. | 48/206 |

FOREIGN PATENT DOCUMENTS

| | | | |
|---|---|---|---|
| 2146039 | 4/1985 | United Kingdom | 48/202 |

*Primary Examiner*—Peter Kratz

*Attorney, Agent, or Firm*—Karl F. Ross; Herbert Dubno

[57] ABSTRACT

Solid fuels are gasified in a fixed bed under a pressure from 5 to 100 bars by a treatment with oxygen, water vapor and carbon dioxide. The raw gas from the gasifier is cooled so that an aqueous condensate is formed, at least part of which is burnt in a fluidized bed furnace at temperatures in the range from about 750° to 1000° C. The resulting combustion gas contains water vapor and is supplied to the gasifier. The condensate which becomes available as the raw gas is cooled may be treated in a separator to remove at least part of its dust and tar contents before the condensate is supplied to the fluidized bed furnace. A circulating fluidized bed is preferably maintained in the fluidized bed furnace.

3 Claims, 1 Drawing Figure

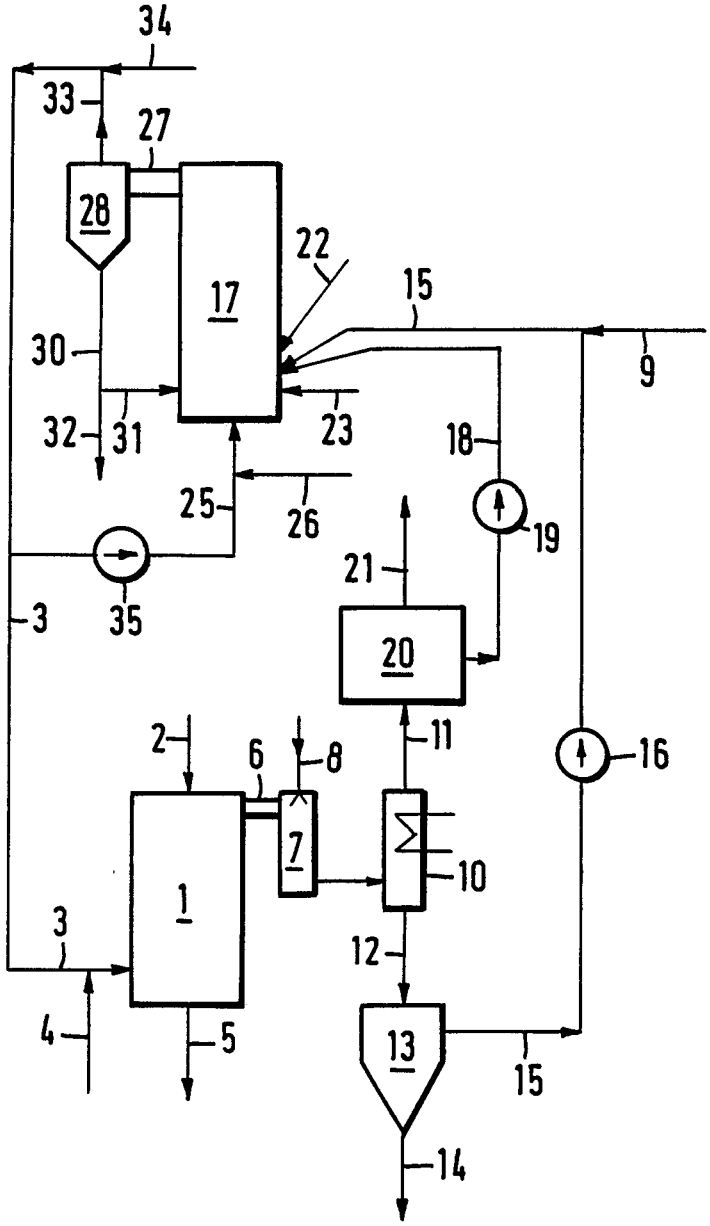
34
33
27
28
17
22
15
9
30
32
31
23
18
19
25
26
21
20
3
35
2
6
8
11
16
7
10
1
3
12
4
5
13
15
14

PROCESS FOR TREATING AQUEOUS CONDENSATE

FIELD OF THE INVENTION

This invention relates to a process for treating aqeuous condensate obtained by the cooling of raw gas produced by the gasification of solid fuels with gasifying agents which contain oxygen, water vapor and carbon dioxide under a pressure of 5 to 100 bars, wherein the fuels constitute a fixed bed which descends slowly and the incombustible mineral constituents of the fuel are withdrawn below the bed as solid ash or liquid slag.

BACKGROUND OF THE INVENTION

The gasification of solid fuels, particularly of coal or brown coal, in a fixed bed in processes leaving a solid ash has been described, e.g., in Ullmanns Enzyklopädie der technischen Chemie, 4th edition (1977), Vol. 14, on pages 383 to 386. Details of that known gasifying process have also been published in U.S. Pat. Nos. 3,560,867 and 3,854,895. The gasification of fuel in a fixed bed processes including a tapping of liquid slag has been explained in British patent specifications Nos. 1,507,905, 1,506,671 and 1,512,677. In the process described in European Pat. No. 12 456 and the corresponding U.S. Pat. No. 4,295,864 the condensate which results from the cooling of the raw gas under superatmospheric pressure is pressure-relieved so that flashed-off vapor and a liquid phase are obtained. The flashed-off vapor is supplied to a combustion chamber and is burnt therein at temperatures above 800° C. Part of the liquid phase must be removed from the process and must be aftertreated because otherwise the concentration of the impurities in the gas or in the condensate would increase to excessive levels. Considerable costs are incurred in the aftertreatment and purification of liquid.

OBJECT OF THE INVENTION

It is an object of the invention to provide a simple and economical process by which that part of the condensate which cannot be recycled to the gasifier and cannot be re-used to treat the raw gas can be eliminated.

SUMMARY OF THE INVENTION

This object can be accomplished in accordance with the invention in that at least part of the condensate is burnt in a fluidized bed furnace at a temperature in the range from about 750° to 1000° C. and the combustion gas, which contains water vapor, is supplied from the furnace to the gasifier. In that case it is not necessary to purify part of the condensate and the combustion gas is used in the gasifier as a gasifying agent.

In accordance with a further feature of the invention the condensate which results from the cooling of the raw gas is treated in a separator to remove at least part of its dust and tar contents before the condensate is supplied to the fluidized bed furnace. Dust and tar are recycled to the gasifier in known manner.

Part of the combustion gas is suitably recycled to the fluidized bed furnace in which the gas is used as fluidizing fluid.

The process offers also the desirable possibility to remove sulfur compounds and carbon dioxide from the raw gas when it has been cooled and to supply said substances to the fluidized bed furnace together with calcium compounds. As a result, the $CO_2$ is preserved for the gasifying process so that less coal is consumed. The sulfur compounds, particularly $H_2S$, are converted to $SO_2$ in the fluidized bed furnace and combine with the calcium compounds consisting mainly of limestone or milk of lime to form calcium sulfate. Calcium sulfate is then withdrawn from the furnace together with the ash and can be dumped without difficulty.

In accordance with a preferred feature of the process the fluidized bed furnace is operated under a pressure which exceeds the pressure in the gasifier by at least 2 bars. In that case the combustion gas need not be additionally compressed before it is supplied to the gasifier.

Because the raw gas and the condensate recovered from the raw gas as it is cooled become available approximately under the pressure which prevails in the gasifier, the separator for treating the condensate is desirably operated under approximately the same pressure as the gasifier. As a result, there is no need for a pressure relief of the condensate and for a treatment of flashedoff gases and a lower pumping power will be required for introducing the liquids which have been withdrawn from the separator into the fluidized bed furnace.

In the process in accordance with the invention the entire water vapor required for the gasification can readily be obtained from the water vapor content of the combustion gas coming from the fluidized bed furnace so that a steam generator for generating additional water vapor for the gasification is no longer required. The process can be carried out without a treatment of flue gases, e.g. a scrubbing of flue gases, because nitrogen oxides and sulfur oxides are reduced in the gasifier and become available as $N_2$ and $H_2O$, respectively, and $H_2S$ can be removed together with other sulfur compounds from the raw gas as it is purified. As a result, the process in accordance with the invention does not involve an emission of $SO_2$ or nitrogen oxides, water is saved and the consumption of coal is decreased by the re-use of $CO_2$. Because the combustion in the fluidized bed results in a purification, the entire process is friendly to the environment. The fact that slightly more oxygen is consumed than in known processes is not significant.

An orthodox fluidized bed or, preferably, a circulating fluidized bed, may be maintained in the fluidized bed furnace. Details of the latter have been described in German Patent Publication No. 25 39 546 and the corresponding U.S. Pat. No. 4,165,717. In the circulating fluidized bed the fluidizing gas flows at much higher velocities than in the orthodox fluidized bed so that solids are continuously discharged from the fluidized bed reactor at high rates and are separated from the gas and recycled to the fluidized bed reactor.

BRIEF DESCRIPTION OF THE DRAWING

Details of the process in accordance with the invention will now be explained with reference to the drawing, the sole FIGURE of which is a flow diagram.

SPECIFIC DESCRIPTION

Granular coal having a particle size range from about 3 to 60 mm is supplied in line 2 to the gasifier 1. Lock chambers are not shown in the drawing for the sake of simplicity. The gasifier 1 contains a fixed bed of solid fuel and is operated under a pressure in the range from 5 to 100 bars. Gasifying agents are supplied through line 3 and consist of a combustion gas and of oxygen, which is added to said gas through line 4. The incombustible gasification residue consists of solid ash or liquid slag and is withdrawn in line 5.

The raw gas produced in the gasifier flows in line 6 to a scrubber-cooler 7, which is supplied through line 8 with water or condensate consisting mainly of water. A further cooling is effected in the succeeding waste heat boiler 10 so that the raw gas withdrawn through line 11 is at temperatures in the range from 120° to 180° C. and a condensate at temperatures from 120° to 180° C. becomes available in the sump of the waste heat boiler 10. That condensate is supplied through line 12 to a separator 13.

In the present case the pressure in the separator 13 is only about 1 to 5 bars lower than the pressure in the gasifier 1. In the separator 13, various components of the condensate are separated by gravity in known manner. A heavy phase, which is rich in dust and tar, is withdrawn in line 14 and may also be supplied to the gasifier 1. A high-water phase, which is usually described as ammonia water, is withdrawn in line 15 and is supplied by means of a pump 16 to a fluidized bed furnace 17. Additional water can be supplied in line 9, if required.

The fluidized bed furnace 17 is also supplied through line 18 with an exhaust gas, which is sucked by a fan 19 from a gas purifier 20. The gas purifier 20 is used to treat the raw gas coming from line 11 so as to remove sulfur compounds, particularly $H_2S$, and part of the $CO_2$ by known processes. $CO_2$ and said sulfur compounds are contained in the exhaust gas conducted in line 18. The purified gas consists mainly of hydrogen and carbon monoxide and is available in line 21 for further utilization.

The fluidized bed furnace 17 is supplied through line 22 with a fuel consisting of fine coal having particle sizes up to 10 mm and through line 23 with ground limestone, dolomite or milk of lime. Said calcium compounds are converted to CaO in the furnace 17, which is operated at temperatures from 750° to 1000° C., preferably from 800° to 900° C. The $SO_2$ derived from the sulfur compounds combines with the CaO to form calcium sulfate. The furnace 17 is supplied through line 25 with a fluidizing gas consisting of a recycled partial stream of the combustion gases and of admixed oxygen, air or oxygen-enriched air supplied through line 26.

Because the fluidizing gas in the furnace 17 flows at high velocities, solids at considerable rates are continuously entrained by the combustion gases out of the combustion zone and are supplied through line 27 to a cycline 28, in which most of the solids are removed from the gas. The solids consisting mainly of fuel ash and calcium sulfate leave the cyclone 28 in line 30. About 80 to 90% of said solids are recycled through line 31 to the furnace 17. The remaining solids are withdrawn in line 32 and may be dumped, e.g., after they have been cooled by means which are not shown. The fluidized bed furnace 17, the transfer line 27, the cyclone 28, and the lines 30 and 31 constitute equipment which is typical of a circulating fluidized bed.

After most of the solids have been removed in the cyclone 28 from the combustion gas, the latter is conducted in line 33 at temperatures from 750° to 1000° C., preferably from 800° to 900° C. That gas is cooled and its water vapor content is increased by a supply of sprayed water, which is conducted in line 34 and may consist of condensate or ammonia water. Part of the combustion gas which has been enriched with water vapor is then recycled through the fan 35 and the line 25 to the furnace 17 in the manner described hereinbefore. The remaining combustion gas is supplied in line 3 to the gasifier 1.

SPECIFIC EXAMPLES

In a plant as shown on the drawing the gasifier 1 is supplied with 1000 kg coal (calculated without water and ash). The coal has a particle size range from 5 to 40 mm and contains 51 kg moisture, 126 kg ash and 21 kg sulfur. The gasifying agent supplied through line 3 consists of a combustion gas which contains the following gaseous components:

$CO_2$ 107 $sm^3$
$O_2$ 7 $sm^3$
$N_2$ 2 $sm^3$ and 323 kg water vapor. The gas is at a temperature of about 400° C. 477 $sm^3$ oxygen from line 4 are admixed to the combustion gas. The pressure in the gasifier 1 is about 30 bars and in the furnace 17 about 32 bars.

In the waste heat boiler 10 operated at a temperature of 180° C., 230 kg condensate become available, which contains 185 kg water. That water is separated in a separator 13 as ammonia water, which is supplied in line 15 to the furnace 17. 20 kg raw water are added through line 9. The exhaust gas produced in the gas purifier 20 consists of 49 $sm^3$ $CO_2$, 14 $sm^3$ $H_2S$ and 1 $sm^3$ COS and through the compressor 19 and the line 18 is also supplied to the furnace 17, in which a circulating fluidized bed is maintained. The furnace 17 is also supplied with 26 kg finegrained coal, 110 kg ground limestone and 76 $sm^3$ oxygen. The combustion gas in line 33 is at a temperature of 850° C. and is supplied with 96 kg of sprayed raw water from line 34 so that the combustion gas is cooled to 400° C. 2200 $sm^3$ pure gas are withdrawn from the gas purifier 20 in line 21.

I claim:

1. A process for treating aqueous condensate obtained by the cooling of raw gas produced by the gasification of granular solid fuels with gasifying agents which contain oxygen, water vapor and carbon dioxide under a pressure of 5 to 100 bars, wherein the fuels constitute a fixed bed which descends slowly and the incombustible mineral constituents of the fuel are withdrawn below the bed as solid ash or liquid slag, comprising the steps of:

(a) cooling the raw gas from the gasification and producing a cold raw gas having a temperature in the range of 120° to 180° C. and a raw condensate;
(b) treating said raw condensate in a separator and withdrawing a heavy phase which is rich in dust and tar and a high-water phase;
(c) removing sulfur compounds from said cold raw gas and part of the carbon dioxide in a purification zone;
(d) withdrawing from said zone a purified gas and an exhaust gas containing sulfur compounds and carbon dioxide;
(e) combusting fine coal in a fluidized bed furnace and feeding said high-water phase, said exhaust gas, calcium compounds and an oxygen-containing gas into said furnace, the temperature in said furnace being maintained at 750° to 1000° C.;
(f) withdrawing from said furnace a combustion gas containing water vapor,;
(g) recycling part of said combustion gas as a fluidizing gas into said furnace; and (h) supplying the balance of said combustion gas into said gasification.

2. The process defined in claim 1 wherein said fluidized bed furnace is operated under a pressure which is at least two bars higher than that at which said gasification is effected.

3. The process defined in claim 1 wherein said separator is operated at substantially the same pressure as that at which gasification is effected.

* * * * *